US010486848B2

(12) United States Patent
Lumia et al.

(10) Patent No.: US 10,486,848 B2
(45) Date of Patent: Nov. 26, 2019

(54) STORAGE CONTAINER WITH SEALABLE OPENING IN BASE

(71) Applicant: Contained Art, LLC, Manalapan, FL (US)

(72) Inventors: Casey Lumia, Manalapan, FL (US); David Lumia, Manalapan, FL (US)

(73) Assignee: Contained Art, LLC, Manalapan, FL (US)

( * ) Notice: Subject to any disclaimer, the term of this patent is extended or adjusted under 35 U.S.C. 154(b) by 0 days.

(21) Appl. No.: 15/683,485

(22) Filed: Aug. 22, 2017

(65) Prior Publication Data

US 2019/0061985 A1 Feb. 28, 2019

(51) Int. Cl.

| | |
|---|---|
| ***B65D 1/10*** | (2006.01) |
| ***B65D 45/16*** | (2006.01) |
| ***B65D 81/36*** | (2006.01) |
| ***B65D 45/24*** | (2006.01) |

(52) U.S. Cl.

CPC ..... *B65D 1/10* (2013.01); *B65D 45/16* (2013.01); *B65D 45/24* (2013.01); *B65D 81/365* (2013.01)

(58) Field of Classification Search

CPC ..... B65D 1/10; B65D 45/16

USPC ..... 206/457, 524.8; 215/2, 205, 239, 284, 215/10, 380, 285, 286; D09/608, 644, D09/609, 610, 626

See application file for complete search history.

(56) References Cited

U.S. PATENT DOCUMENTS

| | | | | | |
|---|---|---|---|---|---|
| 256,857 | A * | 4/1882 | Putnam | B65D 45/24 | 215/285 |
| 520,854 | A * | 6/1894 | Lasch | B65D 45/24 | 215/239 |
| 533,087 | A * | 1/1895 | Rosenfled | B65D 45/24 | 215/239 |
| 1,110,618 | A * | 9/1914 | Follen | B65D 45/24 | 215/239 |
| 1,765,299 | A * | 6/1930 | Crossmore | B65D 1/10 | 215/10 |
| 1,842,226 | A * | 1/1932 | Williams | B65D 39/0023 | 215/262 |
| 2,611,499 | A * | 9/1952 | Mayer | B65D 1/10 | 215/6 |
| 3,765,995 | A * | 10/1973 | Perrin | A47G 7/006 | 215/2 |
| 5,553,735 | A * | 9/1996 | Kimura | A47G 19/2227 | 220/62.18 |

(Continued)

*Primary Examiner* — Chun Hoi Cheung

(74) *Attorney, Agent, or Firm* — McCarter & English, LLP

(57) ABSTRACT

A storage container or storage vessel is provided that includes an opening at its bottom or base. A lid element is provided at the bottom or base of the container/vessel that is movably mounted relative to an opening into the enclosed volume of the container/vessel. A clamping mechanism is associated with the body and lid of the container/vessel so as to releasably lock/secure the lid relative to the body. The body of the container/vessel features an aesthetically and/or artistically desirable shape or design that enhances the appeal and uniqueness of the container/vessel. The lid element of the container/vessel functions as the base of the container/vessel, thereby allowing the entirety of the body of the container/vessel (or such percentage as may be selected in a specific embodiment) to be incorporated into the aesthetically/artistically pleasing body design.

17 Claims, 7 Drawing Sheets

(56) References Cited

U.S. PATENT DOCUMENTS

| | | | | | |
|---|---|---|---|---|---|
| D463,716 | S * | 10/2002 | Seater | D7/599 | |
| D565,423 | S * | 4/2008 | Brady | D21/650 | |
| D693,228 | S * | 11/2013 | Kelley | D9/608 | |
| 8,763,849 | B2 * | 7/2014 | Benetti | A47G 19/2255 | 215/371 |
| 2002/0185388 | A1 * | 12/2002 | Su | A47G 19/2227 | 206/217 |
| 2005/0039398 | A1 * | 2/2005 | Corona | A47G 7/06 | 47/66.6 |
| 2008/0272019 | A1 * | 11/2008 | Miller | B65D 81/365 | 206/457 |
| 2010/0147844 | A1 * | 6/2010 | Connell | A01G 9/021 | 220/62.18 |
| 2015/0329262 | A1 * | 11/2015 | Barbour, Jr. | B65D 51/1644 | 206/524.8 |

* cited by examiner

STORAGE CONTAINER WITH SEALABLE OPENING IN BASE

BACKGROUND

1. Technical Field

The present disclosure is directed to storage container or vessel that includes an opening at its bottom or base. The bottom or base of the container/vessel features a closure element that is movably positioned relative to the opening into the enclosed volume of the container/vessel. A clamping mechanism may be associated with the closure element and body of the container/vessel functions to releasably lock/secure the closure element in a closed position relative to the body. The outer surface of the body of the container/vessel features or defines an aesthetically and/or artistically desirable shape or design that enhances the appeal and uniqueness of the container/vessel. The closure element of the container/vessel functions as the base of the container/vessel when the container/vessel is closed/sealed, thereby allowing the entirety of the external surface body of the container/vessel (or such percentage as may be selected in a specific embodiment) to be incorporated into the aesthetically/artistically pleasing body design.

2. Background Art

A wide variety of storage containers and storage vessels have been developed to facilitate storage of items, e.g., foodstuffs, herbs, grains and the like. Typical storage containers/vessels include the storage container/vessel itself and a detachable/removable lid. Various modes of interaction of storage containers/vessels and associated lids are known. For example, the lid may be adapted to detachably mount with respect to the container/vessel by way of screw or thread-based mechanism, a snap-fit mechanism or an interference fit mechanism. Storage containers/vessels are also known with lids that are hingedly mounted with respect to the body of the container/vessel.

Air tight sealing of a container/vessel may be accomplished with a wire bail closure mechanism that operates to detachably secure a lid relative to a container/vessel, e.g., a glass jar. See, e.g., U.S. Pat. No. 256,857 to Putnam. A gasket or seal is commonly positioned in proximity to the opening of the container/vessel such that the lid engages the gasket/seal when moved into a closed/sealing orientation. Thus, in conventional storage jars that feature a wire bail clamping mechanism, the lid may be rotated so as to cover the opening of the jar, thereby engaging the gasket/seal that is positioned at the rim of the opening, and the wire bail clamping mechanism may be actuated to seal the jar in a closed position. When it is desired to access the content of the jar, the wire bail clamping mechanism is released, the lid is rotated away from the opening of the jar, and the jar's contents may be accessed (or material may be introduced to the jar).

Conventional storage containers/vessels for achieving basic storage functionality and, in many instances, air tight sealing, e.g., jars that include a wire bail clamping mechanism. However, the aesthetic/artistic design of conventional storage jars have heretofore been restricted by conventional thinking that the opening of the storage container/vessel—and the associated opening/lid interaction—should be at the "top" of the container/vessel. In other words, any effort to introduce desirable aesthetic/artistic features to a container/vessel has been severely hampered by the fact that, in conventional designs, the container/vessel design must accommodate an opening with associated lid/closure at or near the top of the container/vessel. Thus, a need exists for a storage container/vessel with effective storage functionality that also accommodates desirable aesthetic/artistic designs for the body of the container/vessel. In addition, a need exists for a storage container/vessel that provides a detachable and/or removable closure mechanism that does not impede or restrict desirable aesthetic/artistic designs for the external surface of the body of the container/vessel. These and other needs are satisfied by the storage containers and storage vessels of the present disclosure.

SUMMARY

According to the present disclosure, advantageous storage containers and storage vessels are provided. The disclosed storage container/vessel generally includes (i) a body defining an external surface, an internal volume dimensioned to store one or more items, and an opening in communication with the internal volume, and (ii) a closure element that is configured and dimensioned to occlude the opening of the body. The closure element generally functions as a base for the body when in an occluding position relative to the opening of the body. In addition, the external surface of the body advantageously defines an aesthetic or artistic configuration. Indeed, a wide range of highly desirable aesthetic/artistic forms may be implemented according to the present disclosure. Several exemplary aesthetic/artistic implementations are disclosed herein (with reference to the accompanying figures), but as will be readily apparent to persons skilled in the art, the present disclosure is not limited by or to the exemplary implementations described and/or disclosed herein.

The storage container of the present disclosure may optionally include a clamping mechanism. The clamping mechanism may be physically mounted with respect to the closure element, the body or both. In exemplary embodiments of the present disclosure, the clamping mechanism may take the form of a wire bail mechanism, as is well known in the field of storage jars. A gasket or seal may be positioned on the closure element and/or in proximity to the opening of the body, e.g., an annular gasket/seal positioned adjacent a rim that defines the opening of the body. The gasket/seal may advantageously be positioned within an annular channel defined in or formed at the periphery of the closure element or in the external surface of the body. The gasket/seal may be fabricated from any suitable flexible/elastomeric sealing material, e.g., neoprene rubber, EPDM rubber, nitrile (Buna-N) rubber, silicone rubber and the like. For storage containers/vessels to be used in storage of food products, pharmaceuticals/nutritional supplements, tobacco/cannabis or other materials/products to be ingested, inhaled or consumed, the selection of gasket/seal material should be of an appropriate food grade, e.g., FDA approved. In exemplary embodiments, the body and the closure element together provide an air-tight seal for purposes of the items stored in the internal volume of the body.

The body may be fabricated from various materials, e.g., glass, plastic, metal, stone, ceramic, porcelain and combinations thereof. Similarly, the closure element may be fabricated from various materials, e.g., glass, plastic, metal, stone, ceramic, porcelain, cork and combinations thereof. In exemplary embodiments, the body and the closure element are fabricated from the same material, e.g., both are fabricated from glass, both are fabricated from a ceramic, etc. It is also contemplated that the body and the closure element may be fabricated from different materials (in whole or in part), e.g., a ceramic body and a glass closure element, etc.

The shape of the opening in the body may take various forms. For example, the geometry of the opening may define a circle, an ellipse, an oval, a rectangle, a square, a polygon and combinations thereof. The size of the opening is not critical, provided it is of sufficient size to permit convenient introduction and removal of items to/from the internal volume.

By providing a storage container featuring the closure element as the base of the container (when in the closed/sealed configuration), essentially infinite flexibility arises with respect to the shape, contours and dimensions of the body of the storage container. For example, the closure element may defines a perimeter (e.g., a circular, elliptical or polygonal perimeter), and the outer surface of the body may include at least one region that extends outward relative to the perimeter of the closure element when the closure element is in the closed/sealed position. Alternatively, the entire perimeter of the body may extend outwardly of the closure element perimeter over a substantial extent of the body.

Of particular significance for purpose of the present disclosure is the fact that the closure element defines a base plane when in the occluding position relative to the body. In other words, the closure element provides a flat/planar surface upon which the storage container may rest, e.g., when positioned on a shelf, counter, table or other flat/planar surface. Based on the functionality of the closure element as the base of the storage container (when in the closed/sealed configuration), the body of the storage container need not, and generally does not, define a flat/planar surface other than the rim surrounding the opening. The elimination of any need to incorporate a flat/planar surface into or as part of the body yields unfettered freedom in incorporating aesthetically and/or artistically pleasing designs to the body of the storage container. Thus, in exemplary embodiments of the present disclosure, the base plane defined by the closure element is the only exposed, substantially planar surface associated with the body and the closure element when the closure element is in the occluding position, i.e., the closed/sealed position.

As noted previously, the aesthetic or artistic configuration defined by the body may take essentially any desired form. By way of example, the exposed surface of the body may include at least one of a facial feature, an animal feature, a plant feature and the like. By way of further example, the exposed surface of the body may define a feature that is symmetric or asymmetric relative to various planes that run through the body. It is possible to provide a set of storage containers that function as a set or group, e.g., four storage containers that appear as the members of a band (e.g., the Beatles), three storage containers that appear as Papa Bear, Mama Bear and Baby Bear, three storage containers that appear as the "see no evil", "hear no evil" and "speak no evil" monkeys, etc. The possibilities are limitless, and the present disclosure is not limited by or to any specific aesthetic/artistic implementation—or group/set of aesthetic/artistic implementations—of the storage containers disclosed herein.

In exemplary embodiments of the present disclosure, the storage container may further include a valve mechanism in communication with the internal volume to facilitate removal of air from the interior volume, e.g., a one-way valve such as a duckbill valve. A mechanism may be provided for forcing/evacuating air from the internal volume and out through the one-way valve. For example, the air evacuation mechanism may take the form of a manually actuated pump mechanism, e.g., a conventional pump-type or piston-type assembly that could be detachably secured to the storage container for the limited purpose of forcing air from the interior volume. Alternatively, the air evacuation mechanism may take the form of a powered pump mechanism, e.g., an electrically and/or battery-powered pump mechanism. In still further embodiments, other electronic features/functions may be incorporated into the disclosed storage container, e.g., a lighting mechanism that could be positioned and adapted to provide "back-light" relative to the body of the storage container.

Thus, in exemplary embodiments, the present disclosure provides a storage container with an opening on the bottom and a top region that may take any desired form. Exemplary implementations of the disclosed storage container may function to provide airtight and/or odor tight functionalities. The disclosed storage containers may advantageously include a gasket/seal, e.g., a silicone gasket, and a clamping mechanism, e.g., a metal wire bail closure clip. The closure element may also include features/functions that allow it to screw onto the body of the storage container, snap onto the body of the storage container, hingedly move to/from a sealing orientation, and closure styles and configurations as are known in the art.

To facilitate creation of vacuum conditions within the interior volume of the body of the storage container, a vacuum creating/forming closure element/lid may be provided, e.g., positioned (detachably or permanently) on the top or bottom of the closure element that would evacuate air from the interior volume. As noted above, air evacuation may be effectuated by press of a button (or repeated button actuation) to expel air from the interior volume through a one way valve, e.g., a duck-bill valve. According to exemplary embodiments, the air evacuation mechanism may be built into the closure element so as to maintain its planar attribute, i.e., so as not to negate the functionality of the closure element as a base for the disclosed storage container. Indeed, in exemplary embodiments, the disclosed air evacuation mechanism is associated with a lid that includes/cooperates with a clamping mechanism, e.g., a wire bail closure mechanism, thereby increasing the security of the sealing engagement between the body/closure element of the disclosed storage container.

In further alternative implementations of the disclosed storage container, exemplary embodiments may include one or more of the following features/functions:

1. A rounded (or irregularly shaped) top with a flat bottom opening;

2. A flat top with a flat bottom opening;

3. A top lid/closure element and a bottom lid/closure element, with a horizontal partition positioned in between to define separate compartments. With the disclosed horizontal partition, the storage container would define distinct top and bottom compartments, and the jar/container could sit on the top or the bottom lid/closure element.

4. Same as option #3 described above, but without a partition, i.e., a one compartment jar with a top and bottom lid to access.

5. A storage container that includes a fully wrapped around decal that is adhered and/or fired into the glass/body of the container. In embodiments wherein the wrap-around decal is fired into the glass/body, the decal becomes part of the glass/body. If the decal is adhered or otherwise applied to the outside of the jar/body, it can generally be scratched off.

6. A storage container with multiple top lids/closure elements and/or multiple bottom lids/closure elements, with one or more vertical partitions to separate the interior volume into two or more compartments.

7. Various fabrication methods may be employed in manufacturing the disclosed storage containers, e.g., injection molding, blow molding, ceramic molds, glass molds and any other manufacturing technique to make a storage container.

8. The closure element may be provided with auxiliary tools/accessories, e.g., attached tongs, tweezers or other means of acquiring the contents of the jar/storage container.

9. A non flat bottom lid/closure element with means of securing the jar/storage container in an upright or other intended upright angled position, such as a ring around the outer edge circumference, a plurality of (e.g., three or more) support feet spaced around the base surface.

Additional features, functions and benefits of the disclosed storage containers will be apparent from the description which follows, particularly when read in conjunction with the appended figures.

BRIEF DESCRIPTION OF THE FIGURES

To assist those of skill in the art in making and using the disclosed storage containers, reference is made to the accompanying figures, wherein.

DESCRIPTION OF EXEMPLARY EMBODIMENT(S)

In exemplary embodiments, a storage container or storage vessel is provided that includes an opening at its bottom or base. A lid or closure element is provided at the bottom or base of the container/vessel that is movably mounted relative to an opening into the enclosed volume of the container/vessel. A clamping mechanism may be associated with the body and lid/closure element of the container/vessel so as to releasably lock/secure the lid/closure element relative to the body. The body of the container/vessel features an aesthetically and/or artistically desirable shape or design that enhances the appeal and uniqueness of the container/vessel. The lid/closure element of the container/vessel functions as the base of the container/vessel, thereby allowing the entirety of the body of the container/vessel (or such percentage as may be selected in a specific embodiment) to be incorporated into the aesthetically/artistically pleasing body design.

Figure 1:
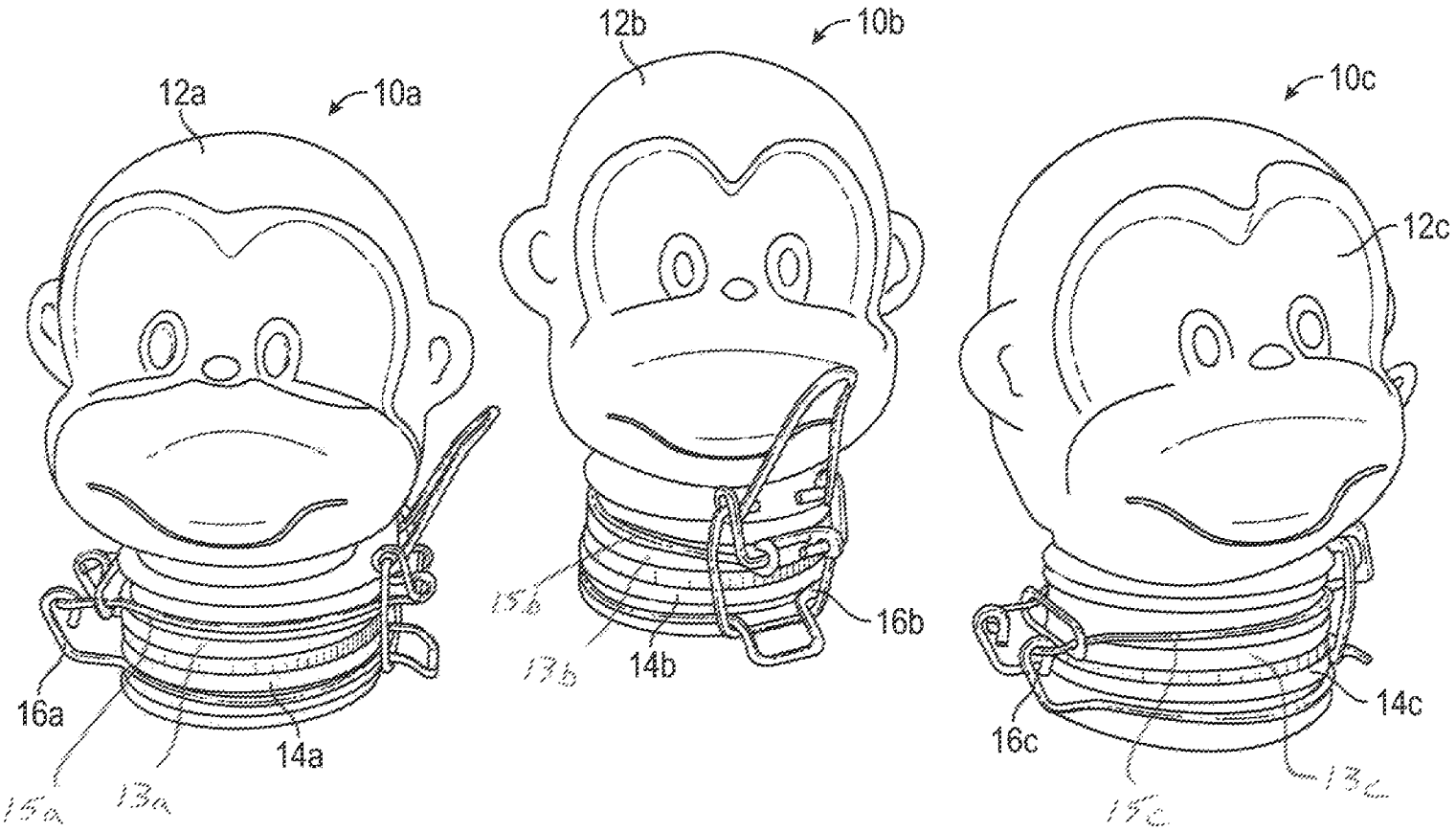
FIG. 1 is a view showing three (3) exemplary storage containers according to the present disclosure.
Figure 5:
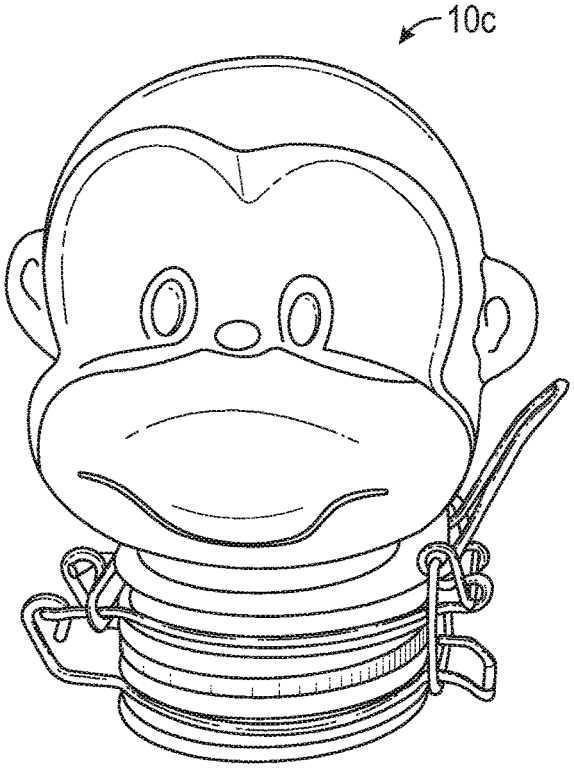
FIG. 5 is a view of one of the storage containers depicted in FIG. 1 according to the present disclosure.

With reference to FIG. 1, a view of three exemplary storage containers 10*a*, 10*b*, 10*c* are provided according to the present disclosure. The storage containers 10*a*, 10*b*, 10*c* include a body 12*a*, 12*b*, 12*c* and closure element 14*a*, 14*b*, 14*c*, respectively. A neck 13*a*, 13*b*, 13*c* extends from body 12*a*, 12*b*, 12*c*, respectively. The closure elements are shown in their closed/occluding position relative to an opening (not visible) defined at the lower end of the body 12*a*, 12*b*, 12*c*. An internal volume for receipt of items/material is defined within body 12*a*, 12*b*, 12*c*. A clamping mechanism 16*a*, 16*b*, 16*c* is associated with each of the storage containers 10*a*, 10*b*, 10*c*. A ring 15*a*, 15*b*, 15*c* associated with clamping mechanism 16*a*, 16*b*, 16*c* is mounted with respect to neck 13*a*, 13*b*, 13*c* in spaced relation relative to body 12*a*, 12*b*, 12*c*, respectively. In the depicted embodiments, the clamping mechanism takes the form of a conventional wire bail mechanism, as is known in the art. Positioning of the ring 15*a*, 15*b*, 15*c* on neck 13*a*, 13*b*, 13*c* in spaced relation relative to body 12*a*, 12*b*, 12*c* allows the clamping mechanism 16*a*, 16*b*, 16*c* to operate without obstruction by or physical contact with body 12*a*, 12*b*, 12*c*. A further view of storage container 10*c* in the closed/sealed configuration is provided in FIG. 5.

Of note, the closure element 14*a*, 14*b*, 14*c* advantageously functions as the base of each of the depicted storage elements 10*a*, 10*b*, 10*c*. Due to the planar aspect of the closure element, the exterior surface of the body 12*a*, 12*b*, 12*c* is free to take on a aesthetically/artistically pleasing design without a requirement that (i) the closure element be received/accommodated by the body in a conventional manner, and/or (ii) a planar surface be defined by the body independent of its interaction with a closure element to function as the base for the storage container. Thus, the exterior surface in the depicted embodiments takes the form of a monkey's face, although alternative aesthetically/artistically desirable designs may, of course, be implemented according to the present disclosure.

As is apparent by comparing storage containers 10*a*, 10*b* with storage container 10*c*, the material of construction and/or coloring/tinting of the bodies and/or closure elements may be varied in the fabrication of the disclosed storage containers. Thus, storage containers 10*a*, 10*b* feature a dark glass material of construction, whereas storage container 10*c* features a cloudy glass material of construction. Alternative materials of construction may be employed, as described above, and with the various materials, varying surface effects, tinting, coloring, finishes, etc., may be employed to achieve a desired look and feel.

Figure 2:
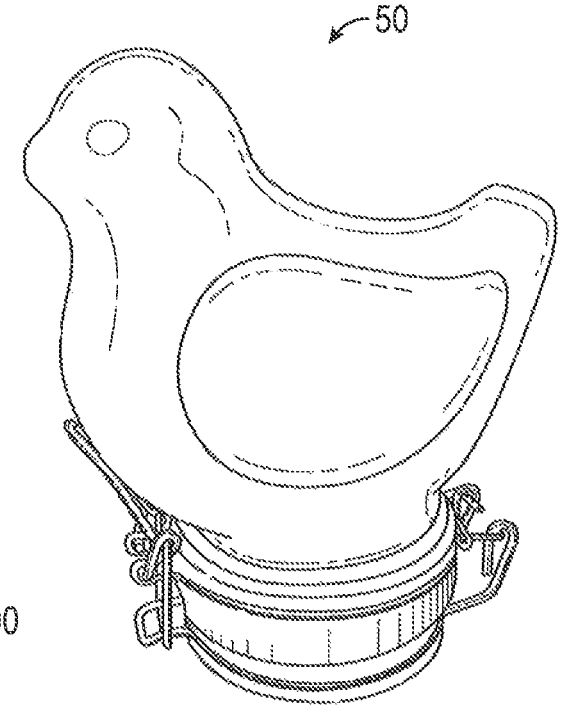
FIG. 2 is a view showing a further exemplary storage container according to the present disclosure.
Figure 4:
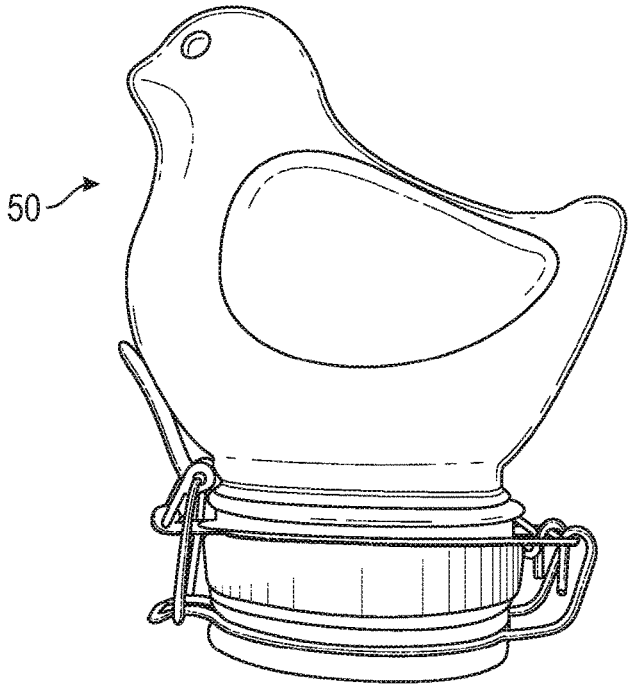
FIG. 4 is a further view showing the exemplary storage container of FIG. 2 according to the present disclosure.

Turning to FIGS. 2 and 4, views of an alternative storage container 50 is provided according to the present disclosure. The overall design and operation of storage container 50 is the same as storage containers 10*a*, 10*b*, 10*c*. However, the aesthetic/artistic design of storage container 50 features a dove (as compared to the monkeys shown in FIG. 1) and the material of construction is a clear glass.

Figure 3:
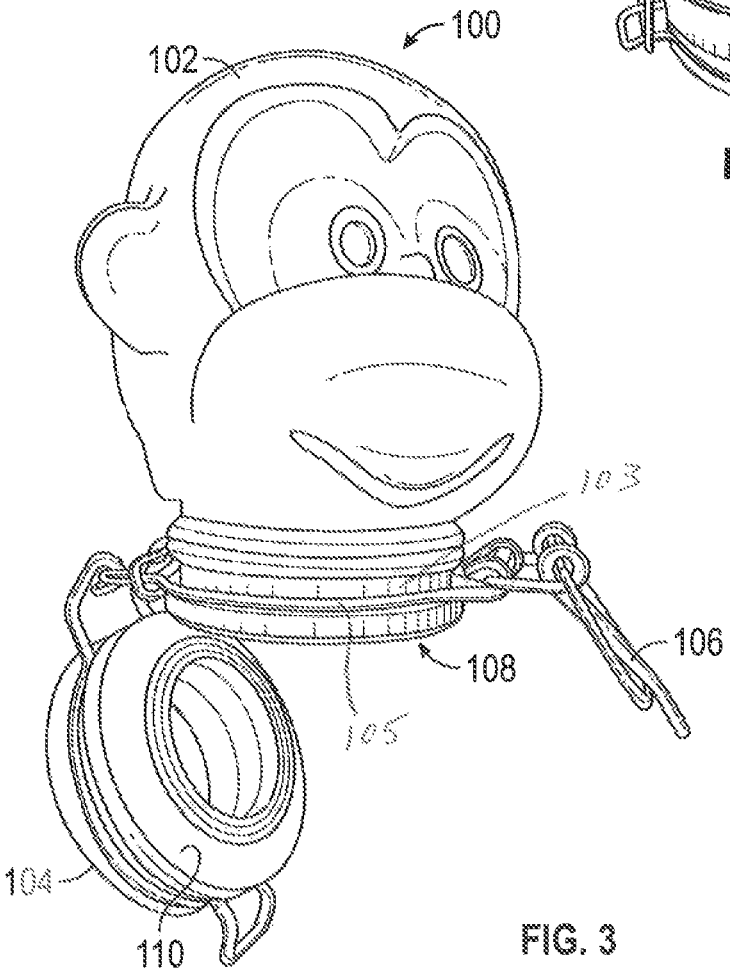
FIG. 3 is a view showing a further exemplary storage container with the closure element rotated into an open/non-sealing orientation according to the present disclosure.

Turning to FIG. 3, a view of an alternative storage container 100 is provided according to the present disclosure. Like storage containers 10*a*, 10*b*, 10*c* shown in FIG. 1, the outer surface of body 102 of storage container 100 features an aesthetic/artistic design that takes the form of a monkey. Unlike the storage containers shown in FIG. 1, storage container 100 has a surface effect that is metallic/reflective. The metallic/reflective effect may be achieved in various ways, e.g., by fabricating the body 102 and/or closure element 104 (in whole or in part) from a metallic material, gilding the manufactured components with a metallic material or painting the manufactured components with a metallic/reflective paint or other surface application.

As shown in FIG. 3, clamping mechanism 106 includes a ring 105 mounted with respect to a neck 103 that extends from body 102, clamping mechanism 106 has been released and closure element 104 has been rotated away from opening 108. Closure element 104 remains hingedly connected to body 102 by way of ring 105 of clamping mechanism 106. A gasket/seal 110 is positioned relative to the periphery of closure element 104 and if/when the closure element 104 is moved into engagement with the neck 103 of body 102, the gasket/seal 110 will provide sealing functionality relative to opening 108.

Figure 6:
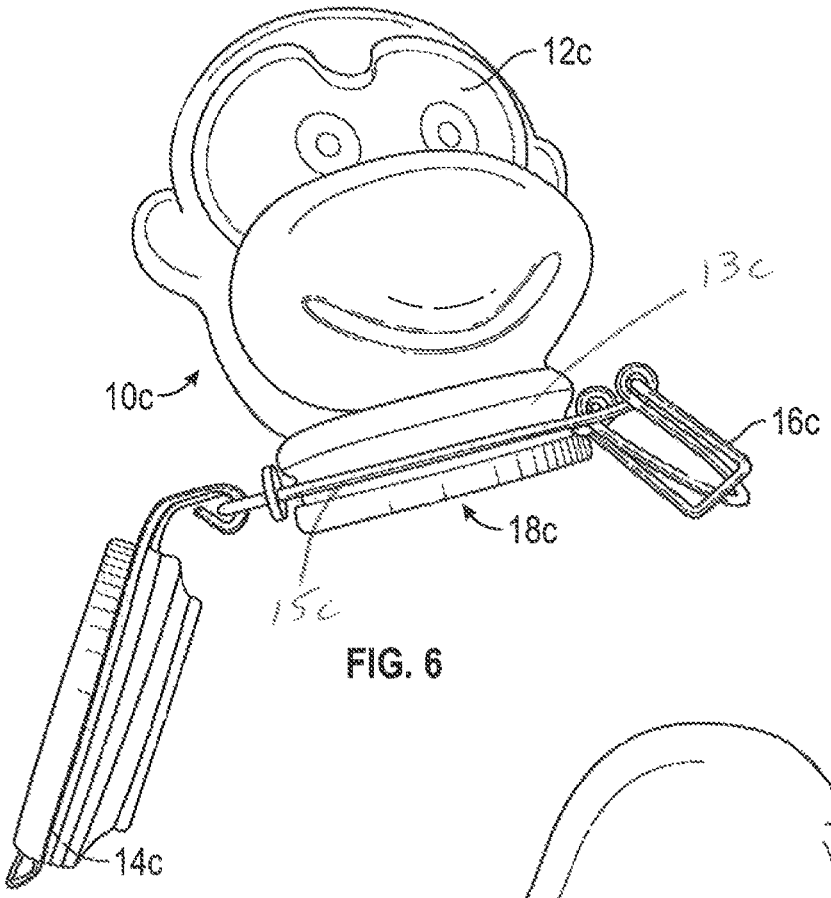
FIG. 6 is a view of the storage container of FIG. 5 with the closure element rotated into an open/unsealed orientation according to the present disclosure.

Like FIG. 3, the view of FIG. 6 shows storage container 10*c* in an open/unsealed configuration. Lid 14*c* is shown rotated away from opening 18*c*.

Figure 7:
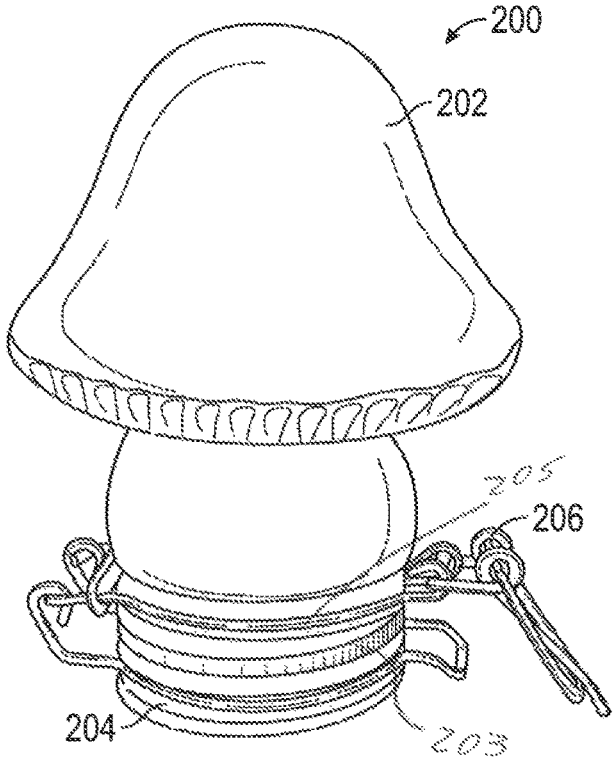
FIG. 7 is a view of a further exemplary storage container according to the present disclosure.
Figure 8:
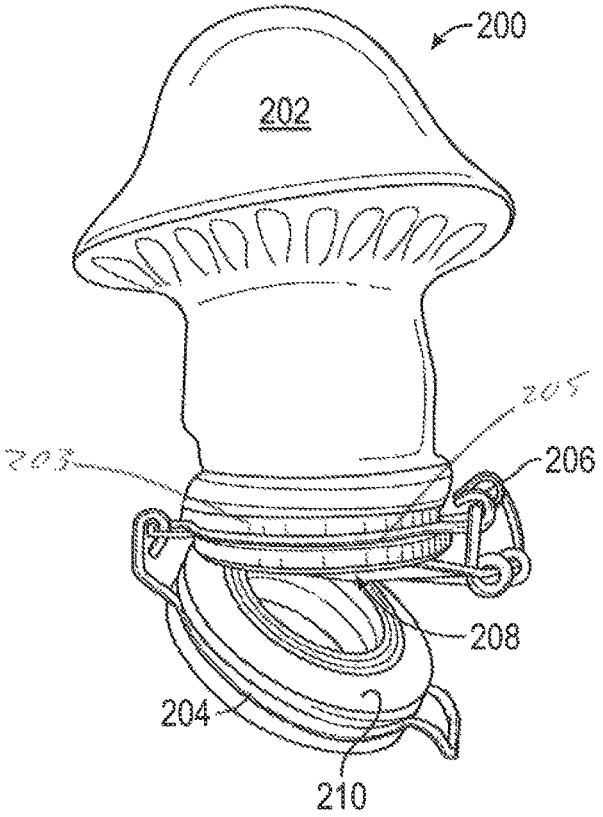
FIG. 8 is a view of the exemplary storage container of FIG. 7 in a partially open configuration according to the present disclosure.
Figure 9:
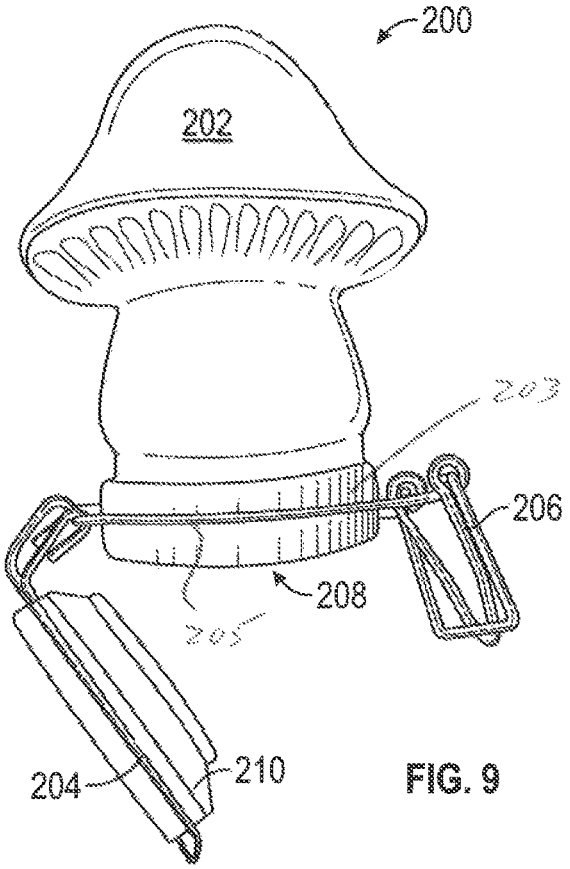
FIG. 9 is a view of the exemplary storage container of FIGS. 7 and 8 in a more substantially open configuration according to the present disclosure.
Figure 10:
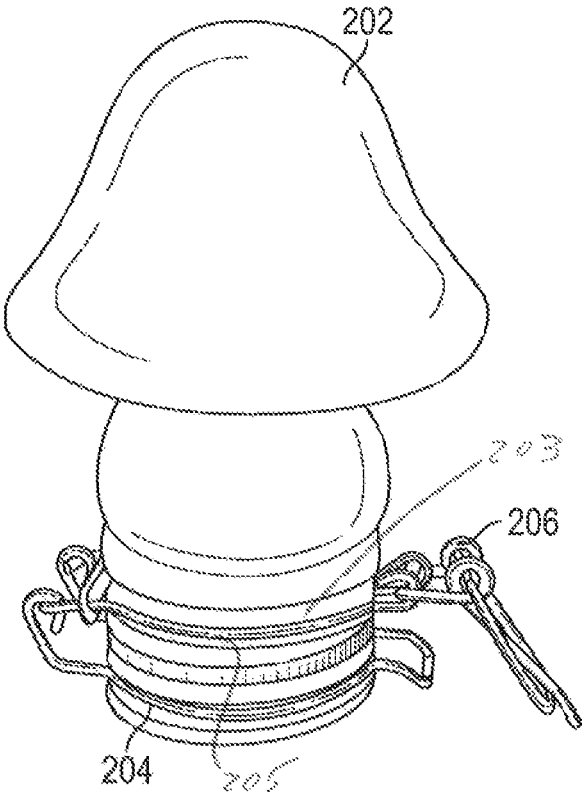
FIG. 10 is a further view of the exemplary storage container of FIGS. 7-9 according to the present disclosure.

Turning to FIGS. 7-10, views of a further storage container 200 are provided according to the present disclosure. Storage container 200 includes a body 202 (that defines an internal volume for receipt of items/materials), a closure element 204 and a clamping mechanism 206. A neck 203 extends from body 202, and ring 205 associated with clamping mechanism 206 is mounted relative to neck 203. As shown in FIGS. 7 and 10, closure element 204 may be moved into sealing engagement with body 202, and clamped in the closed/occluded orientation by clamping mechanism 206. The closure element 204 may also be released and rotated out of sealing engagement with body 202, as shown in FIG. 8 (partial rotation) and FIG. 9 (more substantial rotation), to expose opening 208 which communicates with the internal volume defined within body 202. Sealing gasket 210 is associated with closure element 204.

The outer surface of body 202 of storage container 200 features an aesthetic/artistic feature that provides a mushroom appearance. The material of construction and texture effect of storage container 200 are substantially clear glass. The features/functions of storage container 200 are analogous to those of the previously discussed storage containers. As with each of the storage containers discussed with reference to FIGS. 1-10, the closure element is substantially planar in geometry and functions as the base of the storage container when the closure element is in the closed/occluded orientation.

Figure 11:
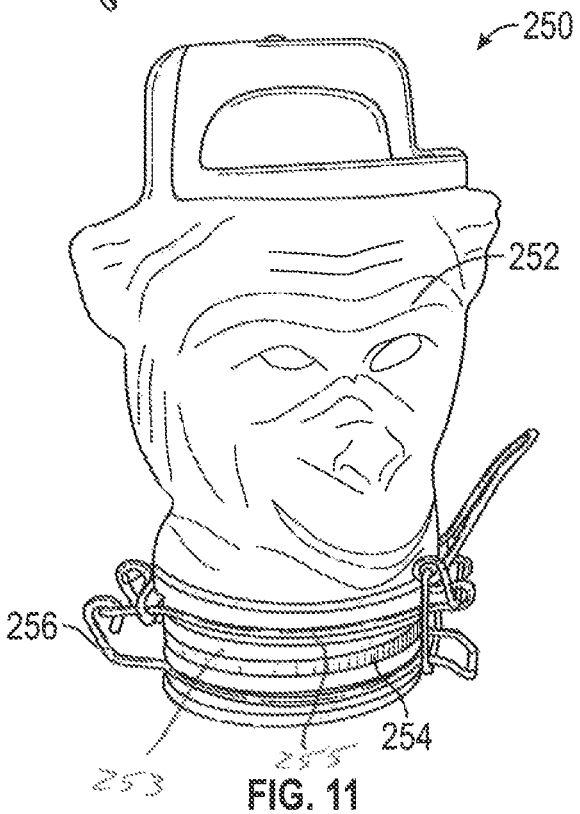
FIGS. 11 and 12 are views of a further exemplary storage container according to the present disclosure.
Figure 12:
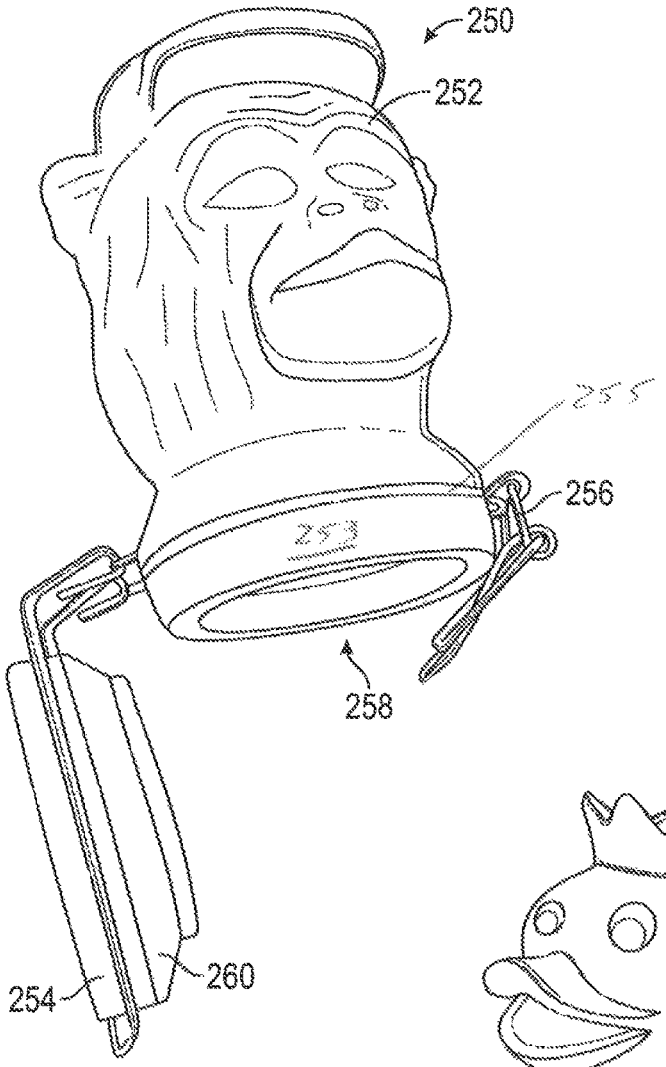

With reference to FIGS. 11 and 12, a further exemplary storage container 250 is provided. Storage container 250 includes body 252, closure element 254 and clamping mechanism 256. A neck 253 extends from body 252, and ring 255 associated with clamping mechanism 256 is mounted relative to neck 253. The exterior surface of body 252 includes an aesthetic/artistic feature that corresponds to a bear with a hat and substantially clear/untinted glass. In the open configuration shown in FIG. 12, opening 208 into the interior volume defined by body 252 is visible, as is sealing gasket 260 associated with closure element 254.

Figure 13:
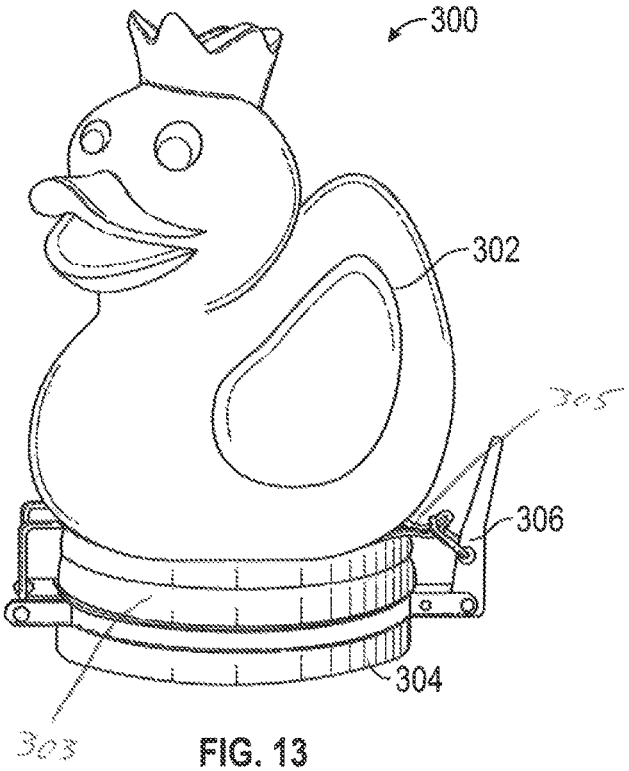
FIG. 13 is a view of a further exemplary storage container according to the present disclosure.

With reference to FIG. 13, a further exemplary storage container 300 is provided according to the present disclosure. Storage container 300 includes a body 302 that defines an outer surface with an aesthetic/artistic feature corresponding to a "rubber duck". The body 302 is fabricated from a plastic or rubber material, and defines an internal volume that communicates with an opening (not visible) at the base of the body 302. A closure element 304 is shown in sealing/occluding engagement with the opening of body 302 and is detachably secured in such orientation by clamping mechanism 306. A neck 303 extends from body 302, and ring 305 associated with clamping mechanism 306 is mounted relative to neck 303. With the exception of the aesthetic/artistic effect associated with the outer surface of body 302, the design and function of storage container 300 is as described with reference to the preceding storage containers shown in FIGS. 1-12.

Although the present disclosure has been described with reference to exemplary embodiments, the present disclosure is not limited by or to such exemplary embodiments and/or exemplary implementations.

The invention claimed is:

1. A storage container comprising:

a. a body having an external face, the body consisting of a single wall defining an external surface and an internal surface, the internal surface of the wall bounding an internal volume dimensioned to store one or more items, the external surface of the single wall being outwardly directed relative to the internal volume of the body for the entirety of the external face of the body;

b. a neck extending from the body and defining an opening;

c. a planar closure element configured and dimensioned to occlude and seal the opening of the neck; and d. a wire bail clamping mechanism hingedly connecting the closure element relative to the body, the wire bail clamping mechanism including a ring that is mounted relative to the neck of the body in spaced relation from the body;

wherein the closure element functions as a base for the body when in an occluding position relative to the opening of the body neck;

wherein the external surface of the body defines an aesthetic or artistic configuration, wherein the wall forms a region opposite the opening of the neck that is larger than the opening of the neck and that has an outwardly projecting geometry that is rounded or irregularly shaped;

wherein no access to the internal volume of the body is permitted unless the wire bail clamping mechanism is released and the planar closure element is moved away from its occluding position; and wherein the wire bail clamping mechanism operates without obstruction by or physical contact with the body.

2. The storage container of claim 1, further comprising a gasket or seal separate from the planar closure element and positioned in proximity to the opening of the neck.

3. The storage container of claim 1, wherein in combination, the body, the neck and the closure element provide an air-tight seal.

4. The storage container of claim 1, wherein the body is fabricated from a material selected from the group consisting of glass, plastic, metal, stone, ceramic, porcelain and combinations thereof.

5. The storage container of claim 1, wherein the closure element is fabricated from a material selected from the group consisting of glass, plastic, metal, stone, ceramic, porcelain, cork and combinations thereof.

6. The storage container of claim 1, wherein the opening of the neck defines a geometry selected from the group consisting of a circle, an ellipse, an oval, a rectangle, a square, a polygon and combinations thereof.

7. The storage container of claim 1, wherein the closure element defines a perimeter, and wherein the outer surface of the body includes at least one region that extends outward relative to the perimeter of the closure element when the closure element is in the occluding position.

8. The storage container of claim 1, wherein the closure element defines a base plane when in the occluding position relative to the neck.

9. The storage container of claim 8, wherein the base plane defined by the closure element is the only exposed, substantially planar surface associated with the body and the closure element when the closure element is in the occluding position.

10. The storage container of claim 1, wherein the aesthetic or artistic configuration defined by the body includes at least one of a facial feature, an animal feature and a plant feature.

11. The storage container of claim 1, wherein the aesthetic or artistic configuration defined by the body is asymmetric.

12. The storage container of claim 1, wherein the neck includes a rim surrounding the opening and wherein the only planar surface defined by the neck is the rim.

13. The storage container of claim 1, wherein the neck defines a rim surrounding the opening and wherein an annular gasket or seal is positioned adjacent the rim.

14. The storage container of claim 1, further comprising a lighting mechanism associated with the body.

15. The storage container of claim 1, wherein the aesthetic or artistic configuration defined by the body includes a set of features that include an upper aesthetic feature and a lower aesthetic feature, and wherein the upper aesthetic feature is spaced further from the base of the body as compared to the lower aesthetic feature.

16. The storage container of claim 15, wherein the upper aesthetic feature is a pair of eyes associated with a face, and wherein the lower aesthetic feature is a mouth associated with the face.

17. The storage container of claim 15, wherein the upper aesthetic feature is a mushroom, and wherein the lower aesthetic feature is a stem for the mushroom.

* * * * *